US005617891A

United States Patent [19]

True

[11] Patent Number: 5,617,891

[45] Date of Patent: *Apr. 8, 1997

[54] SIPHON APPARATUS

[76] Inventor: Donovan B. True, 5509 Lake Rd., Oshkosh, Wis. 54901

[ * ] Notice: The portion of the term of this patent subsequent to Mar. 17, 2011, has been disclaimed.

[21] Appl. No.: 169,292

[22] Filed: Dec. 17, 1993

[51] Int. Cl.[6] ..... F04F 10/00

[52] U.S. Cl. ..... 137/145; 137/212

[58] Field of Search ..... 137/145, 212

[56] References Cited

U.S. PATENT DOCUMENTS

| | | | |
|---|---|---|---|
| 157,474 | 12/1874 | Jenkins | 137/145 |
| 281,396 | 7/1883 | Redmond | 137/145 |
| 349,598 | 9/1886 | Lippincott . | |
| 545,503 | 9/1895 | Hillhouse | 137/145 |
| 556,416 | 3/1896 | Hillhouse | 137/145 |
| 697,835 | 4/1902 | Giorgetti et al. | 137/145 X |
| 922,698 | 5/1909 | Harrison . | |
| 927,360 | 7/1909 | Kolvig | 137/145 |
| 929,990 | 8/1909 | Shields | 137/145 X |
| 1,235,316 | 7/1917 | Henderson . | |
| 1,543,280 | 6/1925 | Darragh . | |
| 2,779,349 | 1/1957 | Teneyck . | |
| 2,867,213 | 1/1959 | Thomas, Jr. . | |
| 3,783,888 | 1/1974 | Johnson . | |
| 4,232,694 | 11/1980 | Williams | 137/148 X |
| 4,310,013 | 1/1982 | McClaskey | 137/145 |

FOREIGN PATENT DOCUMENTS

| | | | |
|---|---|---|---|
| 207252 | 6/1955 | Australia | 137/145 |
| 2406 | of 1873 | United Kingdom | 137/145 |

*Primary Examiner*—Gerald A. Michalsky

*Attorney, Agent, or Firm*—Robert C. Curfiss; Mark A. Tidwell; Butler & Binion, L.L.P.

[57] ABSTRACT

A siphon apparatus having a uniquely designed base for initiating fluid transfer from any fluid container having an opening which is large enough to accommodate a single tube to a desired site in a reasonably short transfer time without the likelihood of spillage or unintentional bodily contact with the fluid being transferred. The siphon apparatus includes the base having two distinct openings for inserting a pressure inducing device and a fluid transfer tube. The base also includes an internal channel for connecting the pressure tube opening to the fluid transfer tube opening thereby allowing air introduced into the pressure inducing tube to enter the sealed fluid container through the opening for the fluid transfer tube. The apparatus may be stored in a compact carrying case or may be hung on a wall by forming the pressure inducing tube and the fluid transfer tube into a single tubular loop.

16 Claims, 3 Drawing Sheets

SIPHON APPARATUS

BACKGROUND OF THE INVENTION

The subject invention is generally related to a siphon apparatus which utilizes pressure greater than ambient pressure to initiate fluid transfer flow from a container to a desired transfer site and is specifically directed to a siphon apparatus having a base with openings for inserting a fluid transfer tube and a pressurizing tube.

By using a siphon device, fluid can be transferred from a container without necessitating lifting and pouring from the container and the opportunity for spillage is eliminated or significantly reduced. Siphon devices for initiating and sustaining fluid transfer flow from a first site, such as a container, to a desired transfer site, are well known and have been available for many years. The best known siphon apparatus consists of a simple siphon tube having a discharge end and an opposite end which is placed in contact with the fluid to be transferred. Typically, fluid flow is initiated in the siphon tube by a sucking action on the discharge end of the tube. Once siphon action flow has been initiated, the discharge end of the tube is then quickly thrust into a desired transfer site, such as a receiving container, before the fluid has reached the exit of the discharge tube. While a simple siphon tube serves the purpose of initiating fluid flow without lifting and pouring from the fluid's container, it is often difficult to transfer the discharge end of the tube to the receiving container before the fluid has reached the discharge end. Thus, the use of a simple tube often results in an unwanted mouthful of fluid or excessive fluid spillage or both.

More complex siphon devices utilize a system of "squeeze bulb" and in-transfer-line check valves which are employed to generate suction pressure pulses to lift fluid in the transfer tube to a height necessary to induce siphon action. While more complex siphon apparatus may overcome the problems of a simple siphon tube, they are prone to mechanical failure, check valve leakage which prevents generation of sufficient suction pressure to induce siphon action flow and external fluid leakage where the check valve housing mechanism is coupled within the transfer tube. In addition, the presence of check valve mechanisms may introduce an impedance of the fluid flow capability of an otherwise unencumbered fluid transfer tube thereby causing the fluid transfer time to be greater than would otherwise elapse.

Another type of prior art siphon apparatus is illustrated in U.S. Pat. No. 3,783,888 entitled "Siphon", issued to Johnson on Jan. 8, 1974. This type of siphon apparatus consists of two tubes and a cover for sealing the opening of the fluid container. Both tubes pass through the cover to enter the opening of the fluid container. One tube is utilized as the conduit by which a lung-mouth delivered air supply is employed to pressurize the air space above the contained fluid until siphon action flow is initiated. The other tube is utilized as the siphon action tube by which fluid is evacuated from the container.

While this type of siphon apparatus eliminates the problems of the simple siphon tube and avoids the disadvantages of the more complex siphon devices, a major disadvantage is that the opening of the container or first site from which fluid transfer is desired must be large enough to accommodate both the pressurizing and fluid transfer tubes. For example, where the fluid container has a small opening or when the fluid container opening is hidden from view, it may be impossible to position the pressurizing tube in the opening of the container to initiate the siphon action into the fluid transfer tube. Thus, the use of this prior art siphon apparatus imposes a size limitation on the diameter of the fluid transfer tube because the diameter must be small enough so that both the fluid transfer tube and pressurizing tube can be inserted into the opening of the container. By limiting the diameter of the fluid transfer tube, the fluid transfer rate from the first site to the desired transfer site is also limited.

While some of the disadvantages of the prior art siphon devices can be avoided by attaching a fitted cover to the opening of the fluid container, the use of a siphon apparatus with a fitted cover may be severely limited because it is uniquely configured to mate with a certain container opening of a single size and is not universal in application to containers having different sized openings. Moreover, all of the prior art siphon devices which initiate siphon action using a pressurizing tube appear to require that the opening of the fluid container accommodate two tubes and thereby impose a size limit on the diameter of the fluid transfer tube.

Thus, the prior art siphon devices which utilize a tube to initiate the siphon action and another tube to transfer the fluid may be unsuitable or impossible to use in certain applications. For example, such a siphon apparatus would not be desirable in an on-the-water transfer of fuel from a "gasoline can" to the fuel tank fill pipe of a motor boat where a reasonably short fluid transfer time is of importance.

Therefore, there is a need for a simple siphon apparatus which allows fluid to be transferred in a reasonably short transfer time from a first site to a desired site without lifting and pouring, avoids unwanted mouthfuls of fluid, eliminates excessive fluid spillage and can be used to transfer fluid from a container having any size opening provided that the opening of the fluid container is large enough to accommodate a single tube for transferring the fluid. There is also a need for a means for storing the siphon apparatus so that it may be readily utilized and easily stowed.

SUMMARY OF THE INVENTION

The subject invention is directed to an improved siphon apparatus for initiating fluid transfer from a first site to a second desired site in a reasonably short transfer time without the likelihood of spillage or unintentional bodily contact with the fluid being transferred. The siphon apparatus of the subject invention may be assembled in a kit housed in a compact carrying case and is specifically designed to allow fluid to be transferred from any container having an opening which is only slightly larger than is required to accommodate a single tube for transferring the fluid.

In the preferred embodiment, the siphon apparatus initiates siphon action by increasing the pressure in the space above the fluid in the container and includes a device for increasing the pressure, such as a pressure inducing tube, a fluid transfer tube and a uniquely designed base having a raised portion with distinct openings for insertion of the pressure inducing tube and fluid transfer tube. The opening for the fluid transfer tube continues through the raised portion and forms a through hole in the base. The fluid transfer tube and pressurizing tube are constructed from a flexible material. However, certain applications may require rigid tubing and the tubes may be constructed from a rigid material when desired.

The base of the preferred embodiment includes an internal channel for connecting the pressure tube opening to the through hole in the base for the fluid transfer tube. In use, the base is placed over and covers the opening of the fluid container and each tube is inserted into and forms a seal with the raised portion of the base. The opening for the fluid transfer tube consists of openings in the raised portion of the base and in the base bottom. Because the diameter of the opening at the outlet of the raised portion which leads into the base bottom and to the through hole is slightly larger than the diameter of the fluid transfer tube opening in the raised portion top, an airway is formed in the base between the periphery of the fluid transfer tube and the section of the base from the outlet to the through hole exit. The siphon action is initiated by introducing air into the pressure tube. The air travels from the pressure tube through the internal channel in the base to the through hole and enters the sealed fluid container through the large area but small radial width airway formed between the periphery of the fluid transfer tube and the through hole in the base.

Because air is introduced into the container around the periphery of the opening for the fluid transfer tube, the unique design of the base requires less radial width to accommodate the fluid transfer tube and a large area air flow passageway than could be accommodated by the fluid transfer tube and an air inlet tube positioned in an adjacent opening. Thus, because the container opening does not have to accommodate two side by side tubes, a fluid transfer tube with a larger diameter, only slightly smaller than the diameter of the container opening, can be used. Therefore, the subject invention facilitates a shorter fluid transfer time and more positive alignment of the air passageway with the container opening.

The preferred embodiment of the invention may include a threaded attachment extending downward into the fluid container from the fluid transfer through hole in the base. The threaded attachment may include either an internally or externally threaded surface so that the siphon apparatus may be threadably secured to a fluid container, such as, by way of example, to the threaded opening of a waterbed when draining the bed. Alternatively, the base may include a tapered portion making it possible to form a universal seal with any of a plurality of different sized openings.

Also, to prevent even the slightest possibility of the air passageway not being fully contained within the container interior, the preferred embodiment may include a short sleeve attachment extending downward into the fluid container and surrounding the fluid transfer tube peripheral airway.

Further, the preferred embodiment of the invention may include a check valve, such as a "duck-bill" in line with the pressurizing air flow which would be utilized to allow air to pass unidirectional into the fluid container but would block air from returning into the pressurizing tube. The addition of the check valve permits delivery of air into the container in pulses and thereby increases the volume of air which can be delivered over the amount which could have been delivered by one lung-mouth delivered expulsion.

Further, the preferred embodiment of the subject invention may include a resilient member, such as an O-ring, positioned on the end of the pressure tube which is inserted into the pressure opening on the raised portion of the base. The addition of an O-ring provides increased resistance for ensuring that the pressure tube does not disengage from the base during use of the siphon apparatus.

In the preferred embodiment of the subject invention, the siphon apparatus may be assembled in a kit and contained in a carrying case. The carrying case may be a pouch or bag such as a resealable plastic bag, such as, by way of example, a ZIP-LOC bag which is readily transported and can be easily stored in a glove compartment or other convenient storage place.

The preferred embodiment of the subject invention may also include a means for conveniently storing the siphon apparatus without separating the fluid transfer tube from its position in the base. In this embodiment, the pressurizing tube ends are sized to fit within the ends of the fluid transfer tube. After use and when storing, the pressurizing tube is removed from the base and each end of the pressurizing tube is inserted into each end of the fluid transfer tube. When the ends are joined a dust tight seal is formed which protects the interiors of the pressurizing tube and fluid transfer tube from dirt contamination. Also, joining the ends of the tubes forms a loop for hanging the siphon apparatus on a wall, such as on a hook in the garage. Because the loop is formed while the fluid transfer tube remains in its use position on the base, the apparatus is more easily stored and readily utilized.

Therefore, it is an object and feature of the subject invention to provide a siphon apparatus for initiating fluid transfer from a first site to a second desired site which can be readily used in any situation where an opening of a fluid container will accommodate a single tube for transferring the fluid in a reasonably short transfer time without the likelihood of spillage or unintentional bodily contact with the fluid being transferred.

it is also an object and feature of the subject invention to provide a siphon apparatus which has a fluid transfer tube, a pressure tube and a uniquely designed base having a raised portion with distinct openings in which the tubes are inserted.

It is a further object and feature of the subject invention to provide a siphon apparatus with a uniquely designed base which includes an internal channel for providing a passageway into the fluid container for air introduced into the pressure tube.

It is yet another object and feature of the subject invention to provide a siphon apparatus which includes a threaded attachment for threadably securing the base to a fluid container.

It is also another object and feature of the subject invention to provide a siphon apparatus which includes a base having a tapered portion for providing a universal seal for use with fluid containers having different sized openings.

It is a further object and feature of the subject invention to provide a siphon apparatus which includes a base having an external downwardly extending sleeve portion which surrounds the fluid transfer tube peripheral airway to positively assure that air does not escape and is delivered into the container.

It is a further object and feature of the subject invention to provide a siphon apparatus which includes a resilient member, such as an O-ring, for ensuring that the pressurizing tube does not disengage from the base.

It is a further object and feature of the subject invention to provide a check valve, such as a "duck-bill" in line with the pressurizing air flow to assure one-way air flow and to build air pressure in pulses.

It is a further object and feature of the subject invention to provide a carrying case for storing and transporting the pressurizing tube, fluid transfer tube and base.

It is also an object and feature of the subject invention to provide a siphon apparatus which includes a pressurizing tube with ends which form a friction fit with the ends of the fluid transfer tube while the fluid transfer tube is positioned in the base to create a single tubular loop which protects the interior of the tubes against dirt and which allows the tubing and attached base to be hung on a wall hook.

Other objects and features will be readily apparent from the accompanying drawings and description.

DETAILED DESCRIPTION OF THE DRAWINGS

Figure 1:
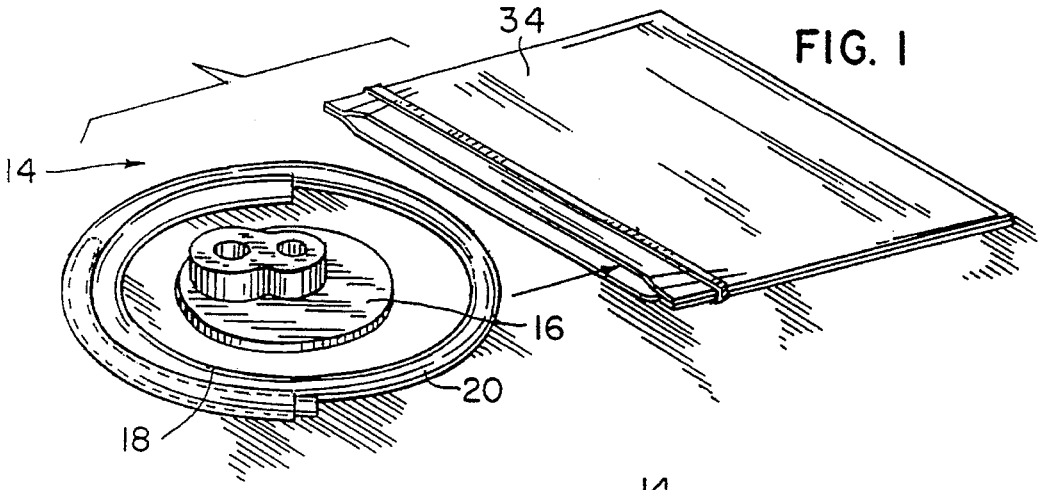
FIG. 1 is a perspective view of a siphon apparatus and a carrying case for storing and transporting the apparatus.
Figure 2:
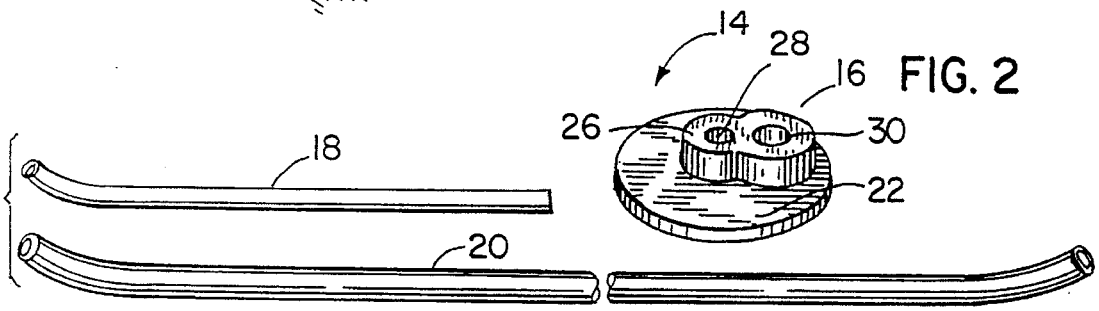
FIG. 2 is a perspective view of the disassembled siphon apparatus including pressurizing tube, fluid transfer tube and a base having a raised portion with distinct openings for insertion of the pressurizing tube and fluid transfer tube.
Figure 3:
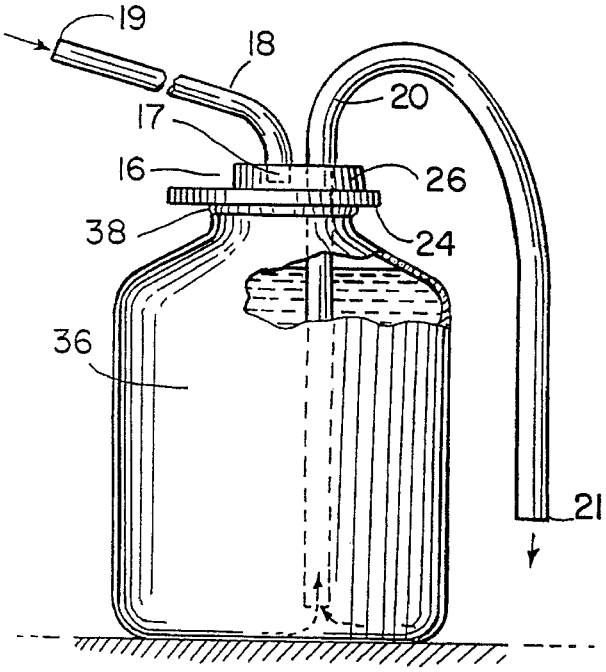
FIG. 3 is a view of an assembled siphon apparatus illustrating the apparatus in use.
Figure 5:
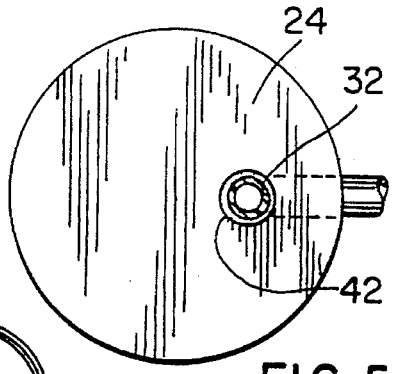
FIG. 5 is a view looking in the direction of arrows 5—5 of FIG. 4 showing the bottom surface of the base with the through hole for the fluid transfer tube.

Referring specifically to FIGS. 1 and 2 of the drawings, the siphon apparatus of the subject invention is designated generally by the reference numeral 14 and comprises a base 16, a pressure inducing tube 18 and a fluid transfer tube 20. The base 16 includes a top surface 22 and a bottom surface 24 (FIG. 3). The top surface 22 includes a raised portion 26 having separate openings 28 and 30 for insertion of the pressure inducing tube 18 and fluid transfer tube 20, respectively. The bottom surface 24 includes a single through hole 32 for the fluid transfer tube 20 and is best shown in FIG. 5. In the preferred embodiment, the fluid transfer tube 20 and the pressure inducing tube 18 are constructed from a flexible material but, when desired, may be constructed from a rigid material.

Figure 6:
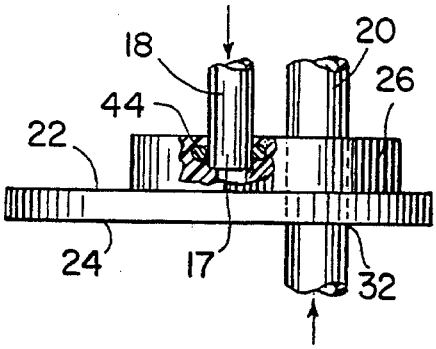
FIG. 6 is a view similar to FIG. 4 showing the openings in the base and the resilient member for ensuring that the pressurizing tube does not disengage from the base.

As shown in FIG. 1, the siphon apparatus 14 may be assembled in a kit housed in a compact carrying case, such as a resealable ZIP-LOC brand bag 34 or the like. FIG. 3 illustrates the siphon apparatus 14, as assembled, for transferring fluid from a container 36 having an opening 38 which is large enough to accommodate the fluid transfer tube 20. As shown in FIGS. 3 and 6, the fluid transfer tube opening 30 continues through the raised portion 26 and through the bottom surface 24 of the base 16 allowing the fluid transfer tube 20 to reach into the container 36 while the pressure inducing opening 28 continues only through the raised portion 26.

Figure 4:
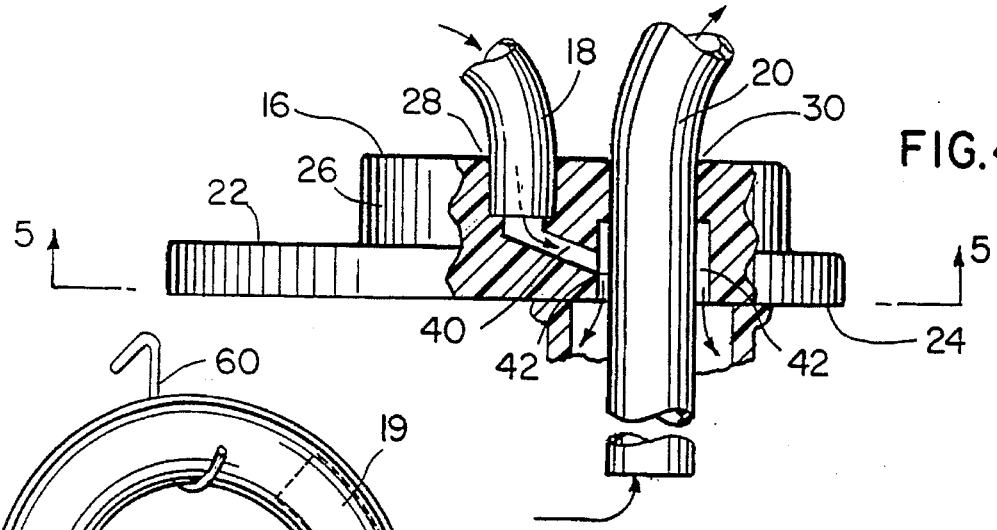
FIG. 4 is an enlarged fragmentary view, looking in the same direction as FIG. 3 and partially in section, of the base illustrating the internal channel for providing a passageway into the fluid container for air introduced into the pressure tube.
Figure 8:
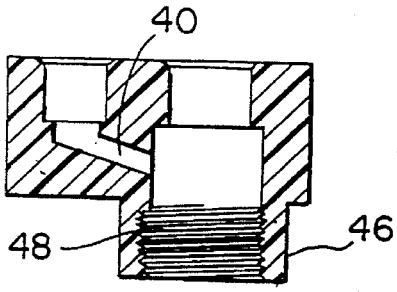
FIG. 8 is a cross-sectional view of an alternative embodiment of the base including an attachment extending downward from the base having an internal thread.

An enlarged cross-sectional view of the base 16 of the preferred embodiment is illustrated in FIG. 4. The base 16 includes an internal channel 40 connecting the pressure tube opening 28 to the through hole 32 in the base 16. As shown in FIG. 8, the diameter of the outlet hole 32 for the fluid transfer tube 20 is slightly larger than the diameter of the fluid transfer opening 30 in the raised portion 26 whereby an airway 42 is formed between the periphery of the fluid transfer tube 20 and the through hole 32 in the base. The airway 42 formed in the through hole 32 is also shown in FIG. 5.

In use, the base 16 is placed over and seals the opening 38 of the container 36 from which fluid is being transferred. Siphon action is then initiated by introducing air into the pressure tube 18. As indicated by the arrows in FIG. 4, the air travels from the pressure tube 18 through the internal channel 40 to the airway 42 and enters the sealed fluid container 36 to initiate the siphon action. Because the siphon action is initiated by air introduced through the same opening 32 which receives the fluid transfer tube 20, the siphon apparatus 14 can be used in any situation where the opening 38 of the fluid container 36 is large enough to accommodate the fluid transfer tube 20 and can be covered by the base 16. Further, in order to ensure that the pressure inducing tube 18 does not disengage from the base 16 during the use of the siphon apparatus 14, a resilient member, such as an O-ring 44, may be positioned between the end 17 of the pressure inducing tube 18 and the wall of opening 28 (see FIG. 6).

Figure 9:
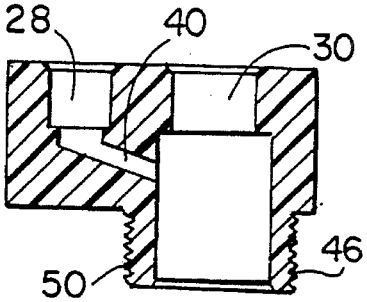
FIG. 9 is a cross-sectional view of an alternative embodiment of the base including an attachment extending downward from the base having an external thread.
Figure 10:
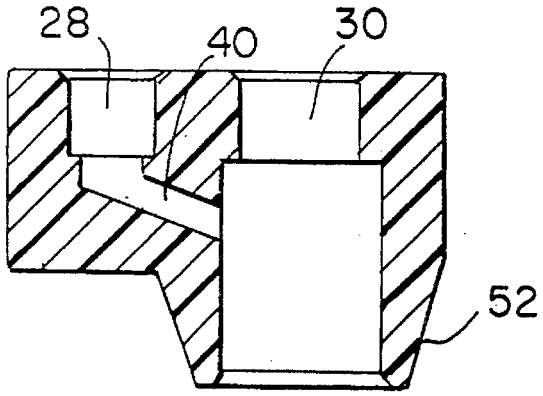
FIG. 10 is a cross-sectional view of an alternative embodiment of the base including a tapered portion extending downward from the base for providing a universal seal.

As shown in the cross-sectional views of FIGS. 8 and 9, the preferred embodiment of the subject invention may include a threaded portion 46 extending downwardly into the container 36. The threaded portion 46 may be internally threaded 48 (FIG. 8) or externally threaded 50 (FIG. 9), as desired, for threadably securing the base 16 to the fluid container 36. Alternatively, the siphon apparatus 14 may also include a base 16 having a tapered portion 52 (see FIG. 10) extending downward from the base 16 and forming a universal seal with any of a plurality of different sized openings 38.

Figure 7:
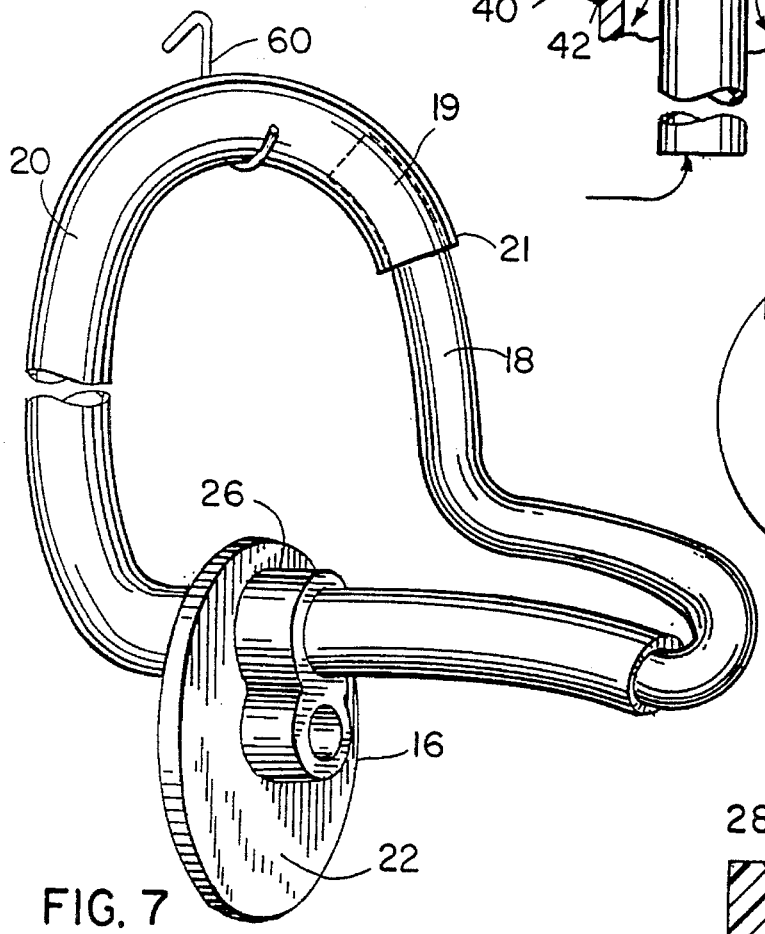
FIG. 7 is a perspective view of the assembled siphon apparatus showing the ends of the pressurizing tube inserted into the ends of the fluid transfer tube while the fluid transfer tube is positioned in the base. By inserting the ends of the pressurizing tube into the ends of the fluid transfer tube, the interior of the tubes is protected from dirt and a loop for storing the apparatus on a hook is formed.

As shown in FIG. 7, the preferred embodiment of the subject invention may be conveniently stored without completely disassembling the apparatus 14. As illustrated, the pressure inducing tube 18 which has been removed from the base 16 has ends 17 and 19 sized such they form a friction fit with the ends 21 and 23 or the fluid transfer tube 20. A singular loop is formed by joining end 17 with end 21 and end 19 with end 23 which protects the interiors of the tubes 18 and 20 from dirt contamination and which permits the transfer tube 20 to remain positioned for use in the base 16 while enabling the apparatus 14 to be hung, such as on a wall hook 60.

Figure 11:
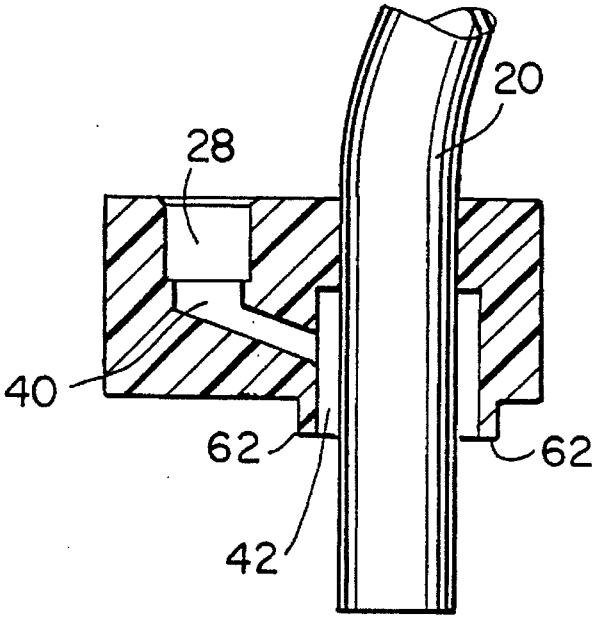
FIG. 11 is a cross-sectional view showing an outer sleeve portion extending downward from the base to enclose the fluid transfer tube and peripheral airway.

As shown in FIG. 11, the preferred embodiment of the subject invention may also include a short sleeve portion 62 extending downward into the container 36. The sleeve portion 62 extends into the container 36 and encloses the fluid transfer tube 20 for ensuring that air delivered through the pressure inducing tube 18 and into the peripheral airway 42 does not escape and enters the container 36.

Figure 12:
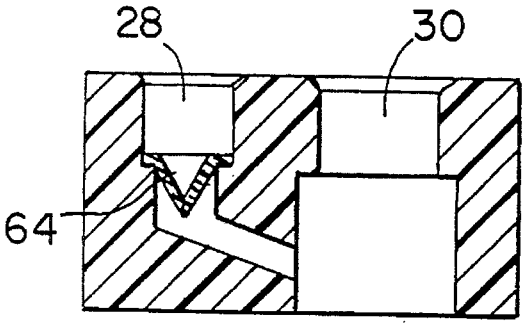
FIG. 12 is a cross-sectional view showing a check valve in line with the pressurizing air flow.

In addition, the preferred embodiment of the subject invention may include a check valve 64 which is positioned in line with the pressurizing air flow (see FIG. 12) for providing unidirectional air flow into the container 36. The addition of the check valve 64 allows air pressure to build in the container 36 in pulses. The check valve 64 may be positioned in the opening 28 for the pressure inducing tube 18. Alternatively, the check valve 64 may be contained in the pressure inducing tube 18.

While certain features and embodiments of the invention have been described in detail herein, it will be readily understood that the invention includes all modifications and enhancements within the scope and spirit of the following claims.

What is claimed is:

1. A siphon apparatus using pressure to initiate a fluid transfer from a first site to a second site, comprising:

a. a fluid transfer tube for transferring the fluid from the first site to the second site;

b. a pressurizing device for introducing air into and increasing the pressure in the first site for initiating the fluid transfer to the second site;

c. a base having a top and bottom surface, said top surface including a first opening and a second opening, said first opening extending through and forming a through hole in the bottom surface of the base and being adapted to receive the fluid transfer tube, wherein said fluid transfer tube forms a seal adjacent to the top surface of the base when the fluid transfer tube is inserted into the first opening and wherein an outlet opening is larger than the tube to form an airway adjacent to the bottom surface of the base in the through hole between the periphery of the fluid transfer tube and the base; said second opening extending partially into the base and being adapted to receive the pressurizing device, wherein said pressurizing device forms a seal with said second opening; and wherein said bottom surface of the base is placed against and completely covers an opening of the first site; and d. an internal channel in the base extending from the second opening to the through hole in the base, whereby air introduced into the pressurizing device enters the first site through said internal channel and said airway.

2. The siphon apparatus of claim 1, wherein the pressurizing device is a pressurizing tube.

3. The siphon apparatus of claim 2, wherein the pressurizing tube has a first discharge end and a second connecting end, said second end being inserted into the second opening and said pressurizing tube further including a resilient member positioned at the second end for increasing resistance at the second end for preventing the pressurizing tube from disengaging from the base.

4. The siphon apparatus of claim 2, further including a check valve for providing unidirectional air flow in line with the pressurizing tube.

5. The siphon apparatus of claim 2, wherein the fluid transfer tube has a first diameter and the pressurizing tube has a second smaller diameter, said tubes each having opposite ends and wherein the ends of the pressurizing tube are inserted into and form a friction fit with the ends of the fluid transfer tube to form a single tubular loop for hanging and storing the assembled siphon apparatus.

6. The siphon apparatus of claim 1, wherein the pressurizing device is a nozzle.

7. The siphon apparatus of claim 1, the base further comprising a raised portion including the first and second openings; wherein said first opening extends through the raised portion and continues through the base to form the through hole and said second opening extends through the raised portion; and wherein the seal is formed between the fluid transfer tube and the first opening in the raised portion and said internal channel extends from the second opening in the raised portion to said through hole in the base.

8. The siphon apparatus of claim 1, wherein the bottom surface of the base is flat.

9. The siphon apparatus of claim 1, the bottom surface further including a threaded attachment extending downwardly from the through hole on the bottom surface of the base, said threaded attachment being adapted to threadably secure the base to the first site.

10. The siphon apparatus of claim 9, wherein the opening of the first site has an external thread adapted to engage the threaded attachment and wherein the threaded attachment has an internal thread for securing the base to the first site.

11. The siphon apparatus of claim 9, wherein the opening of the first site has an internal thread adapted to receive the threaded attachment and wherein the threaded attachment has an external thread for securing the base to the first site.

12. The siphon apparatus of claim 1, wherein a portion of the bottom surface extending downwardly from the through hole on the bottom surface of the base is tapered, said portion having a first and second end, the first end adjacent to the through hole on the bottom surface and having a diameter larger than the through hole, said portion extending downward and terminating at the second end having a smaller diameter than the first end, said tapered portion forming a universal seal to accommodate any of a plurality of different size openings in the first site.

13. The siphon apparatus of claim 1, further including an outer sleeve portion extending downwardly from the through hole on the bottom surface of the base and which surrounds the airway peripheral to the fluid transfer tube.

14. An apparatus for transferring fluid from a first site to a second site comprising:

a kit for initiating fluid transfer, said kit having a fluid transfer tube for transferring the fluid from the first site to the second site, a pressurizing device for introducing air into and increasing the pressure in the first site for initiating the fluid transfer to the second site, a base having a top and bottom surface, said top surface including a first opening and a second opening, said first opening extending through said base forming a through hole in the bottom surface of said base and an airway adjacent to the bottom surface of said base, said fluid transfer tube being inserted into the first opening and forming a seal, said second opening extending partially into the base, said pressurizing device forming a seal with said second opening, said bottom surface of the base being placed against and completely covering an opening of the first site, and an internal channel in the base extending from the second opening to the through hole in the base, whereby air introduced into the pressurizing device enters the first site through said internal channel and said airway;

a mechanism for pressurizing the first site; and a mechanism for receiving the fluid transferred through said fluid transfer tube at said second site.

15. The apparatus of claim 14 further comprising a carrier adapted to the fluid transfer tube, a pressurizing tube and the base.

16. The apparatus of claim 14 wherein the fluid transfer tube has a first diameter and a pressurizing tube has a second diameter which is smaller than the first diameter for positioning the pressuring tube insider the fluid transfer tube.

* * * * *